US009499000B2

(12) United States Patent
Shan

(10) Patent No.: US 9,499,000 B2
(45) Date of Patent: Nov. 22, 2016

(54) SUBLIMATION TRANSFER PAPER FOR INKJET PRINTING

(71) Applicant: Transfer Innovative-Material (Suzhou) Co., Ltd., Suzhou, Jiangsu Province (CN)

(72) Inventor: Chang Shan, Suzhou (CN)

(73) Assignee: TRANSFER INNOVATIVE-MATERIAL, Suzhou, Jiangsu Province (CN)

( * ) Notice: Subject to any disclaimer, the term of this patent is extended or adjusted under 35 U.S.C. 154(b) by 29 days.

(21) Appl. No.: 14/598,204

(22) Filed: Jan. 15, 2015

(65) Prior Publication Data

US 2016/0159128 A1 Jun. 9, 2016

(30) Foreign Application Priority Data

Dec. 4, 2014 (CN) ..... 2014 1 0726797

(51) Int. Cl.
*B41M 5/50* (2006.01)
*B41M 5/52* (2006.01)
*B41M 5/025* (2006.01)

(52) U.S. Cl.
CPC ..... *B41M 5/5236* (2013.01); *B41M 5/0256* (2013.01); *B41M 5/502* (2013.01); *B41M 5/504* (2013.01); *B41M 5/506* (2013.01); *B41M 2205/02* (2013.01)

(58) Field of Classification Search
CPC .. B41M 5/382; B41M 5/38278; B41M 5/44; B41M 5/50; B41M 5/506; B41M 5/5236; B41M 2205/02; B41M 2205/38; B41M 5/42
USPC ..... 503/227; 428/32.11, 32.12, 32.24
See application file for complete search history.

(56) References Cited

U.S. PATENT DOCUMENTS 6,902,779 B1 * 6/2005 de Visser ..... B41M 5/0256 428/32.12
2009/0286021 A1 * 11/2009 Kulibert ..... B41M 5/502 428/32.12

FOREIGN PATENT DOCUMENTS

CN 1315906 A 10/2001
CN 102448731 A 5/2012
CN 203713283 U 7/2014

* cited by examiner

*Primary Examiner* — Bruce H Hess
(74) *Attorney, Agent, or Firm* — Cheng-Ju Chiang

(57) ABSTRACT

The sublimation transfer paper for inkjet printing includes an ink holding layer, a paper fiber bonding layer, a base paper layer, and a back coating layer. The uppermost and lowermost layers of the transfer paper are the ink holding layer and back coating layer, respectively. The paper fiber bonding layer and the base paper layer, or a layer of mixture of a paper fiber binding agent and the base paper layer, must be disposed between the ink holding layer and the back coating layer. The paper fiber bonding layer is coated on the base paper layer using a spreader, the transfer paper of the present invention is added with dry stuffing, therefore drying quickly during printing and has a low extension rate; and during inkjet printing, such transfer paper does not arch and rub the jet nozzle of the printer after absorbing water and is easy to use.

9 Claims, 1 Drawing Sheet

SUBLIMATION TRANSFER PAPER FOR INKJET PRINTING

CROSS REFERENCE

This application claims the benefit of priority to Chinese Patent Application No. 201410726797.3 titled "Sublimation Transfer Paper for Inkjet Printing", filed with the Chinese State Intellectual Property Office on Dec. 4, 2014, the entire disclosure of which is incorporated herein by reference.

BACKGROUND OF THE INVENTION

Technical Field

The present invention relates to the field of sublimation transfer printing, in particular to the sublimation transfer paper for inkjet printing.

Description of the Related Art

Sublimation transfer paper for inkjet printing is usually applied to printing of textiles or materials containing polyester. Ink made by dispersed dyes is printed on the sublimation transfer paper for inkjet printing according to the pattern images through an inkjet printer, then the printed surface fits with the object surface of transfer printing and then is heated to 170-230° C. The dye in the ink is heated and sublimated into the object of transferring, thus realizing transferring of images and texts.

The sublimation transfer paper for inkjet printing enhances the printing accuracy, and more importantly realizes the water-less dyeing of textiles conveniently. The inkjet printer can directly print colorful and vivid patterns on the sublimation transfer paper for inkjet printing under the control of the computer without procedures like platemaking, and after a simple heating procedure, the object of the transfer printing can achieve a delicate printing effect.

The sublimation transfer paper for inkjet printing is usually manufactured by coating an ink holding layer capable of holding ink or called a blocking layer on the base paper. On the one hand, this layer can absorb ink; on the other hand, it can block the dye dispersed in the ink seeping into the paper fiber and affecting escaping while heating. Methods for making the sublimation transfer paper for inkjet printing are widely disclosed by the prior arts, and most of them entail coating an ink holding layer (commonly known as a ink receiving layer or blocking layer) on one side of the base paper made from water-soluble glue such as polyvinyl alcohol, hydrolyzed starch, carboxymethyl-cellulose, alginate, gelatin, and ammonium polyacrylate to name a few. For example, the patent application No. 998104809 Transfer Paper for Ink Printing discloses a transfer paper for ink printing which has a coating with at most porosity of 100 ml/min, the ink holding layer made from carboxymethyl-cellulose; the patent application No. 201080022469.5 Preparation of Transfer Paper for Ink Printing discloses an sublimation transfer paper for inkjet printing with an ink holding layer made from ammonium polyacrylate, carboxymethyl-cellulose and glycerinum to name a few. The patent application No. 201320744741.1 Quick-Dry Sublimation Transfer Paper with High Transfer Rate discloses that the ink holding layer of the heat sublimation transfer paper employs high-molecular polymer or natural glue, and the sublimation transfer paper for inkjet printing has a four-layer structure, having a greater 'absorption layer' for absorbing water in comparison with the conventional three-layer structure, thus improving the printing drying speed of the sublimation transfer paper for inkjet printing.

Carboxymethyl-cellulose has a poor ink-bearing capability and needs a relatively large amount coating; in addition, the carboxymethyl-cellulose in the transfer paper absorbs water and expands such that the paper extends and arches to rub the jet nozzle of the printer; although adding an 'absorption layer' for absorbing water between the ink holding layer and the base paper can improve the drying speed, the capability of enhancing the drying speed is limited due to blockage by the ink holding layer.

Therefore, there is an urgent need to overcome the above defects of the prior art by providing the sublimation transfer paper for inkjet printing.

BRIEF SUMMARY OF THE INVENTION

The objective of the present invention is to provide the sublimation transfer paper for inkjet printing to solve problems facing the prior art.

To fulfill the above objective, the present invention employs the following technical solution:

The sublimation transfer paper for inkjet printing includes an ink holding layer, a paper fiber bonding layer, a base paper layer, and a back coating layer; the uppermost layer of the transfer paper is the ink holding layer, and the lowermost layer of the transfer paper is the back coating layer, wherein disposed between the ink holding layer and the back coating layer are the paper fiber bonding layer and the base paper layer or a layer of mixture of a paper fiber binding agent and the base paper layer.

Furthermore, the ink holding layer is used of polyanionic cellulose and dry stuffing.

Preferably, the dry stuffing is one of hydrophobic starch, $SiO_2$, and $CaCO_3$ or a mixture thereof.

Furthermore, the drying stuffing accounts for 1%-90% of the total dry weight of the ink holding layer.

Furthermore, the ink holding layer is coated by one layer or several layers.

Furthermore, the ink holding layer has a total dry weight of 3-20 $g/m^2$.

Preferably, the total dry weight of the ink holding layer is 4-7 $g/m^2$.

Furthermore, the positions of the paper fiber bonding layer and the base paper layer are exchangeable.

Furthermore, the paper fiber bonding layer employs a binding agent, and the binding agent is a water-based resin, any one or the mixture of several of glyoxal, polyamides resin, potassium zirconium carbonate, and styrenic thermoplastic elastomer.

Furthermore, when the water-based resin uses water as the solvent, the solid content of the resin is 1%-50%.

Furthermore, the binding agent of the paper fiber bonding layer can also seep into the base paper layer to form the layer of mixture of the paper fiber binding agent and the base paper layer.

The present invention has the following beneficial effects. The paper fiber bonding layer is coated on the base paper using a spreader or using the inner glue applying machine of the papermaking machine during a manufacturing process of the base paper. The paper fiber bonding layer can be used on manufacturing the base paper with a low elongation in water. It is manufactured for further manufacturing the easy-to-use sublimation transfer paper for inkjet printing with a low elongation. By using the paper fiber bonding layer, a very thin ink holding layer can block the dispersed dye seeping into the paper fibers, and its ink bearing capability is 1.5-2.5 times that of the carboxymethyl-cellulose for bearing the ink dye and over 5 times that of the polyvinyl alcohol, thus effectively improving the transfer rate; the number of pores per square millimeter of the coating is greater than 20, improving the capability of absorbing the ink; the transfer paper of the present invention is added with dry stuffing, therefore drying quickly during printing and paper has a low extension rate; and during inkjet printing, such transfer paper does not arch and rub the jet nozzle of the printer after absorbing water and is easy to use.

Figure 1:
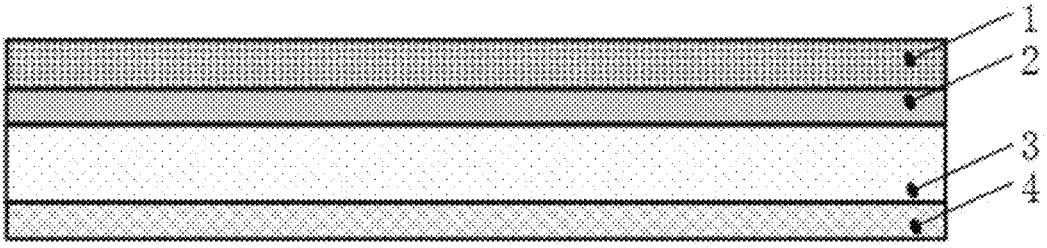
FIG. 1 is a structural view of embodiment 1 of the present invention.

Wherein, 1—Ink holding layer, 2—paper fiber bonding layer. 3—base paper layer. 4—back coating layer, 5—mixing layer of the paper fiber binding agent and base paper layer.

DETAILED DESCRIPTION OF THE INVENTION

To facilitate understanding of the technical means, creation characteristics, objectives and effects of the present invention, the present invention is hereunder described in detail with reference to the specific embodiments.

Explanation of Nouns

Easy-to-use: With the dry stuffing incorporated, the transfer paper dries quickly during printing and has a low extension rate; and during inkjet printing, the transfer paper does not arch and rub the jet nozzle of the printer after absorbing water and is easy to use.

The sublimation transfer paper for inkjet printing comprises an ink holding layer 1, a paper fiber bonding layer 2, a base paper layer 3 and a back coating layer 4; the uppermost layer of the transfer paper is the ink holding layer 1; and the lowermost layer of the transfer paper is the back coating layer 4; wherein disposed between the ink holding layer 1 and the back coating layer 4 are the paper fiber bonding layer 2 and the base paper layer 3 or a layer 5 of mixture of a paper fiber bonding agent and the base paper.

The ink holding layer 1 is made from polyanionic cellulose and dry stuffing.

The dry stuffing is one of hydrophobic starch, $SiO_2$, and $CaCO_3$ or a mixture thereof.

The drying stuffing accounts for 1%-90% of the total dry weight of the ink holding layer 1.

The ink holding layer 1 is coated by one layer or several layers.

The ink holding layer 1 has a total dry weight of 3-20 g/m$^2$; preferably, the total dry weight of the ink holding layer is 4-7 g/m$^2$.

The positions of the paper fiber bonding layer 2 and the base paper layer 3 are exchangeable.

The paper fiber bonding layer 2 employs a binding agent, and the binding agent is a water-based resin, any one or the mixture of several of glyoxal, polyamides resin, potassium zirconium carbonate, and styrenic thermoplastic elastomer.

When the water-based resin uses water as the solvent, the solid content of the resin is 1%-50%.

The binding agent of the paper fiber bonding layer 2 may also seep into the base paper layer 3 to form layer 5 of mixture of the paper fiber binding agent and the base paper layer.

Embodiment 1

As shown in FIG. 1, the sublimation transfer paper for inkjet printing includes an ink holding layer 1, a paper fiber bonding layer 2, a base paper layer 3, and a back coating layer 4; from bottom to top, the back coating layer 4, the base paper layer 3, the paper fiber bonding layer 2 and the ink holding layer 1 together form the transfer paper in sequence.

The base paper layer 3 is quantitated to 30 g/m$^2$; the water absorption value is 80 g/m$^2$; the paper pulp consists of 50% broadleaf wood pulp and 50% needlebush pulp.

The ink holding layer is made from polyanionic cellulose, with a degree of substitution greater than 0.9. The solid weight ratio of the polyanionic cellulose and the hydrophobic starch is 40%: 60%. The mixing process is: dispersing and dissolving the polyanionic cellulose with warm water first, and then adding the hydrophobic starch solution dispersed with cold water in advance, and next mixing the two solutions while the starch is not dissolved. The coating on the ink holding layer is applied using a scraper. One layer of coating is applied. The total dry weight of the coating on the ink holding layer is 3 g/m$^2$.

The paper fiber bonding layer 2 employs the polyurea polyamide resin. The aqueous solution with a solid content of 1% is applied on the upper surface of the base paper layer 3 through roller coating. The dry coating weight is about 0.5 g/m$^2$. After the coating is oven-dried, the paper fiber bonding layer 2 is formed.

The back coating layer 4 is formed by coating the starch aqueous solution with a concentration of 6% on the back side of the base paper layer 3.

The manufactured easy-to-use sublimation transfer paper for inkjet printing has an elongation of 1.5% in water.

Embodiment 2

Figure 2:
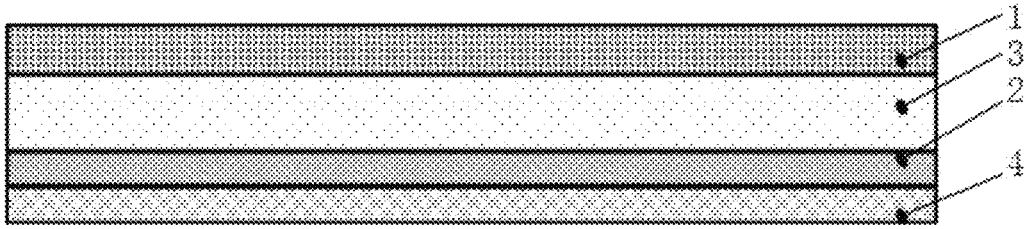
FIG. 2 is a structural view of embodiment 2 of the present invention.

As shown in FIG. 2, the sublimation transfer paper for inkjet printing includes an ink holding layer 1, a paper fiber bonding layer 2, a base paper layer 3, and a back coating layer 4; from bottom to top, the back coating layer 4, the paper fiber bonding layer 2, the base paper layer 3 and the ink holding layer 1 together form the transfer paper in sequence.

The base paper layer 3 is quantitated to 30 g/m$^2$; the water absorption value is 80 g/m$^2$; the paper pulp consists of 50% broadleaf wood pulp and 50% needlebush pulp.

The ink holding layer 1 uses polyanionic cellulose, with a degree of substitution greater than 0.9. The solid weight ratio of the polyanionic cellulose and the hydrophobic starch is 40%: 60%. The mixing process is: the polyanionic cellulose is dispersed and dissolved with warm water first, followed by adding the hydrophobic starch solution dispersed with cold water in advance, and the solution is mixed while the starch is not dissolved. The coating on the ink holding layer 1 is applied using a scraper by one layer. The total dry weight of the coating on the ink holding layer is 3 g/m$^2$.

The paper fiber bonding layer 2 employs the polyurea polyamide resin. The aqueous solution with a solid content of 1% is applied on the lower surface of the base paper layer 3 through roller coating. The dry coating weight is about 0.5 g/m$^2$. After the coating is oven-dried, the paper fiber bonding layer 2 is formed.

The back coating layer 4 is formed by coating the starch aqueous solution with a concentration of 6% on the back side of the base paper layer 3.

The manufactured easy-to-use sublimation transfer paper for inkjet printing has an elongation of 1.5% in water.

Embodiment 3

Figure 3:
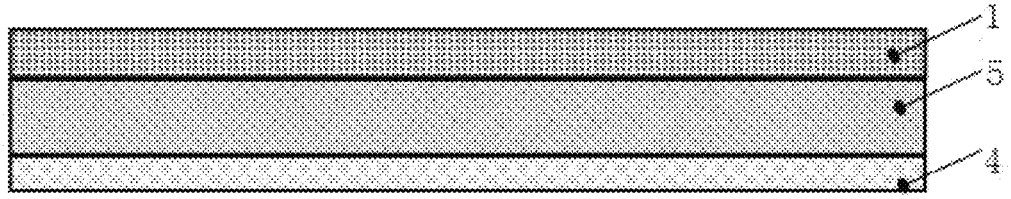
FIG. 3 is the structural view of embodiments 3, 4, and 5 of the present invention.

As shown in FIG. 3, the sublimation transfer paper for inkjet printing includes an ink holding layer 1, a layer 5 of mixture of a paper fiber bonding agent and a base paper layer, and a back coating layer 4; from bottom to top, the back coating layer 4, the layer 5 of mixture of the paper fiber bonding agent and the base paper layer, and the ink holding layer 1 together form the transfer paper in sequence.

The binding agent of the paper fiber bonding layer 2 can also seep into the base paper layer 3 to form the layer 5 of mixture of the paper fiber binding agent and the base paper layer.

The layer 5 of mixture of the paper fiber binding agent and the base paper layer is quantified as 45 g/m$^2$; the water absorption value is 50 g/m$^2$; the paper pulp consists of 85% broadleaf wood pulp and 15% needlebush pulp. In the process of papermaking, the aqueous solution of the polyurethane-polyuria resin with a solid content of 10% is poured into the inner glue applying machine and coated in a soaking mode. The dry coating weight on both sides is about 1.5 g/m$^2$. After oven-drying, the layer 5 of mixture of the paper fiber bonding agent and the base paper layer is obtained. The manufactured base paper has an elongation of 1.0% in water. Then, the base paper with a low elongation is coated and processed to obtain the sublimation transfer paper for inkjet printing. In such circumstances, both sides of the base paper are absorbed with polyurea polyamide resin, the base paper layer and the paper fiber bonding layer are integrated as a whole body.

The ink holding layer 1 uses polyanionic cellulose, with a degree of substitution greater than 1.0. The solid weight ratio of the polyanionic cellulose to the silicon dioxide to the hydrophobic starch is 43%: 2%: 55%. The mixing process is as follows: the polyanionic cellulose is dispersed and dissolved with warm water, followed by adding the silicon dioxide and hydrophobic starch dispersed with cold water in advance; and the solution is mixed while the starch is not dissolved. This coating is applied using a scraper by two layers. The total dry weight of the coating on the ink holding layer is 6 g/m$^2$.

The back coating layer 4 is formed by coating the starch aqueous solution with a concentration of 6% on the back side of the layer 5 of mixture of the paper fiber binding agent and the base paper layer.

The manufactured easy-to-use sublimation transfer paper for inkjet printing has an elongation of 1.45% in water.

Embodiment 4

As shown in FIG. 3, the sublimation transfer paper for inkjet printing includes an ink holding layer 1, a mixing layer 5 of a paper fiber bonding agent and a base paper layer, and a back coating layer 4; from bottom to top, the back coating layer 4, the layer 5 of mixture of the paper fiber bonding agent and the base paper layer and the ink holding layer 1 together form the transfer paper in sequence.

The binding agent of the paper fiber bonding layer 2 can also seep into the base paper layer 3 to form the layer 5 of mixture of the paper fiber binding agent and the base paper layer.

The layer 5 of mixture of the paper fiber binding agent and the base paper layer is quantitated to 55 g/m$^2$; the water absorption value is 100 g/m$^2$; the paper pulp consists of 85% broadleaf wood pulp and 15% needlebush pulp. In the process of papermaking, glyoxal is used as the binding agent. The aqueous solution of the glyoxal with a solid content of 50% is poured into the inner membrane-transfer glue applying machine and coated in a membrane-transfer mode on both sides. The dry coating weight on both sides is about 2 g/m$^2$. After oven-drying, the layer 5 of mixture of the paper fiber bonding agent and the base paper layer is obtained. The manufactured base paper has an elongation of 1.0% in water. Then, the base paper with a low elongation is coated and processed to obtain the sublimation transfer paper for inkjet printing.

The ink holding layer 1 employs polyanionic cellulose, and the hydrophobic starch is used as the dry stuffing. The solid weight ratio of the hydrophobic starch accounts for 90% of the total dry weight of the polyanionic cellulose. The mixing process is as follows: the polyanionic cellulose is dispersed and dissolved with warm water, followed by adding the silicon dioxide and hydrophobic starch dispersed with cold water in advanced; and the solution is mixed while the starch is not dissolved. This coating is applied using screen printing at three different times. The total dry weight of the coating on the ink holding layer is 20 g/m$^2$.

The back coating layer 3 is formed by coating the aqueous solution of starch with a concentration of 8% on the back side of the layer 5 of mixture of the paper fiber binding agent and the base paper layer.

The manufactured easy-to-use sublimation transfer paper for inkjet printing has a high drying speed and has an elongation of 1.4% in water.

Embodiment 5

As shown in FIG. 3, the sublimation transfer paper for inkjet printing includes an ink holding layer 1, a mixing layer 5 of a paper fiber bonding agent and a base paper layer, and a back coating layer 4; from bottom to top, the back coating layer 4, the layer 5 of mixture of a paper fiber bonding agent and a base paper layer, and the ink holding layer 1 together form the transfer paper in sequence.

The binding agent of the paper fiber bonding layer 2 can also seep into the base paper layer 3 to form the layer 5 of mixture of the paper fiber binding agent and the base paper layer.

The layer 5 of mixture of the paper fiber binding agent and the base paper layer is quantitated to 65 g/m$^2$; the water absorption value is 60 g/m$^2$; the paper pulp consists of 85% broadleaf wood pulp and 15% needlebush pulp. In the process of papermaking, the mixture of glyoxal, polyamide resin and potassium zirconium carbonate is used as the binding agent. The aqueous solution of the mixture of glyoxal, polyamide resin, and potassium zirconium carbonate, with a solid content of 25%, is poured into the glue applying device in the machine and coated in a soaking mode on both sides. The dry coating weight on both sides is about 1.5 g/m$^2$. After oven-drying, the layer 5 of mixture of the paper fiber bonding agent and the base paper layer is obtained. The manufactured base paper containing the paper fiber bonding agent has an elongation of 0.9% in water. Then, the base paper with a low elongation is coated and processed to obtain the sublimation transfer paper for inkjet printing.

The ink holding layer 1 employs polyanionic cellulose, and the degree of substitution of the dry stuffing is greater than 1.0. The mixture of the hydrophobic starch and $CaCO_3$ accounts for 45% of the dry weight of the polyanionic cellulose. The mixing process is as follows: the polyanionic cellulose is dispersed and dissolved with warm water, followed by adding the hydrophobic starch and CaCO3 dispersed with cold water in advanced; and the solution is mixed while the starch is not dissolved. This coating is applied using a scraper by two layers. The total dry weight of the coating on the ink holding layer 1 is 7 g/m$^2$.

The back coating layer 4 is formed by coating the aqueous solution of starch with a concentration of 6% on the back side of the layer 5 of mixture of the paper fiber binding agent and the base paper layer.

The manufactured easy-to-use sublimation transfer paper for inkjet printing has an elongation of 1.45% in water.

The method for testing the elongation in water in the above embodiments is (1): the sample paper is dried for 30 min in an oven at a temperature of 70° C. and then placed in a room at a temperature of 23° C. and with a humidity of 50% for 4 h; (2) a sample piece 2 cm wide and 20 cm long is soaked in a water disc with distilled water; (3) the length of the sample paper is measured after 30 min, and the percentage of the extension, namely the elongation in water, of the sample paper is calculated.

The easy-to-use sublimation transfer paper for inkjet printing as mentioned in the above embodiments has the following effects:

1. When the inkjet printer filled with the heat sublimation ink is used to print the easy-to-use sublimation transfer paper for inkjet printing in the embodiments, the colors of the printing color blocks are respectively 100% C, M, Y and K; after the printing lasts for 30 min, the white polyester fabric undergoes the heat transferring for 20 s, and the temperature of the hot plate for transferring is 210° C. After the transferring, the sublimation transfer paper for inkjet printing is compared with the common quick-dry inkjet transfer paper (a commodity of a company, 70 g sublimation transfer paper for inkjet printing, which is the transfer paper of the competitive product), and the observation results of the residue of the transfer paper and the color of the white polyester fabric show that the transfer rates are similar.

2. The easy-to-use sublimation transfer paper for inkjet printing has an enhanced water absorption speed. In case the ink with a concentration of 200% is printed on the sublimation transfer paper for inkjet printing in pure black, the surface drying time is shortened to 5 min (the drying time of the sample transfer paper of the competitive product is 10 min), and when the printing linear speed is 1.0 m/min, the drying device for continuous printing and rolling is not needed.

3. The elongation in water of the sublimation transfer paper for inkjet printing of the competitive product is 1.9%, and that of the easy-to-use sublimation transfer paper for inkjet printing is 1.5%. The inkjet printer prints using 200% ink, the paper has no obvious arch and does not rub the nozzle, the paper is fed and printed smoothly, and the paper edge is rolled in order.

The paper fiber bonding layer of the present invention is coated on the base paper using a spreader or using a built-in dispenser of a papermaking machine during a manufacturing process of the base paper. Or, the base paper with a low elongation in water is manufactured for further manufacturing the easy-to-use sublimation transfer paper for inkjet printing with a low elongation; a very thin ink holding layer can block the dispersed dye seeping into the paper fibers, and its ink bearing capability is 1.5-2.5 times that of the carboxymethyl cellulose for bearing the ink dye and over 5 times that of the polyvinyl alcohol, thus effectively improving the transfer printing rate; the number of pores per square millimeter of the coating is greater than 20, improving the capability of absorbing the ink; when the paper containing the paper fiber bonding layer undergoes the inkjet printing, the ink moistens the paper fibers, the paper fibers absorb ink and expand, but the papers are bonded and do not extend. When the easy-to-use sublimation transfer paper for inkjet printing is printed, it does not arch and rub the jet nozzle.

The basic principle, main characteristics, and advantages of the present invention are depicted and described above. The technical personnel in the industry should know that the present invention is not limited by the above embodiments. The above embodiments and description only depict the principle of the present invention. The present invention has various changes and modifications on the premise of without departing from the spirit and scope of the present invention. Those changes and modifications all shall fall within the protective scope of the present invention. The protective scope of the present invention is defined by its claims and equivalents.

What is claimed is:

1. A sublimation transfer paper for inkjet printing, comprising: an ink holding layer, a paper fiber bonding layer employing a bonding agent therein, a base paper layer and a back coating layer; wherein the ink holding layer is an uppermost layer of the transfer paper, and the back coating layer is a lowermost layer of the transfer paper, wherein disposed between the ink holding layer and the back coating layer are the paper fiber bonding layer and the base paper layer or a layer of mixture of the binding agent and the base paper layer; and wherein the ink holding layer is made of polyanionic cellulose and dry stuffing used for stuffing gaps in the ink holding layer.

2. The sublimation transfer paper for inkjet printing as claimed in claim 1, wherein the dry stuffing is one of hydrophobic starch, $SiO_2$, and $CaCO_3$ or a mixture thereof.

3. The sublimation transfer paper for inkjet printing as claimed in claim 1, wherein the drying stuffing accounts for 1%-90% of the total dry weight of the ink holding layer.

4. The sublimation transfer paper for inkjet printing as claimed in claim 1, wherein the ink holding layer is coated by one layer or several layers.

5. The sublimation transfer paper for inkjet printing as claimed in claim 1, wherein the ink holding layer has a total dry weight of 3-20 g/m$^2$.

6. The sublimation transfer paper for inkjet printing as claimed in claim 1, wherein the positions of the paper fiber bonding layer and the base paper layer are exchangeable.

7. The sublimation transfer paper for inkjet printing as claimed in claim 1, wherein the binding agent is water-based resin, which is any one selected from a group of glyoxal, polyamides resin, potassium zirconium carbonate and styrenic thermoplastic elastomer, or a mixture of at least two selected from the group.

8. The sublimation transfer paper for inkjet printing as claimed in claim 7, wherein when the water-based resin uses water as the solvent, the solid content of the resin is 1%-50%.

9. The sublimation transfer paper for inkjet printing as claimed in claim 1, wherein, the binding agent of the paper fiber bonding layer seeps into the base paper layer to form the layer of mixture of the binding agent and the base paper layer.

* * * * *